US005231835A

United States Patent [19]

Beddome et al.

[11] Patent Number: 5,231,835

[45] Date of Patent: Aug. 3, 1993

[54] LIQUEFIER PROCESS

[75] Inventors: Robert A. Beddome, Tonawanda; Joseph A. Weber, Cheektowaga, both of N.Y.

[73] Assignee: Praxair Technology, Inc., Danbury, Conn.

[21] Appl. No.: 894,587

[22] Filed: Jun. 5, 1992

[51] Int. Cl.[5] ..... F25J 1/00

[52] U.S. Cl. ..... 62/9; 62/36

[58] Field of Search ..... 62/8, 9, 36, 38

[56] References Cited

U.S. PATENT DOCUMENTS 3,855,810 12/1974 Simon et al. ..... 62/9
4,638,639 1/1987 Marshall et al. ..... 62/9
4,778,497 10/1988 Hanson et al. ..... 62/11
4,894,076 1/1990 Dobracki et al. ..... 62/9

OTHER PUBLICATIONS

High Efficiency Turboexpander in an $N_2$ Liquefier, paper presented at the AIChE 1985 Spring Meeting, Houston, Texas Mar. 24–28, L. C. Kun and T. C. Hanson pp. 1–12.

*Primary Examiner*—Ronald C. Capossela
*Attorney, Agent, or Firm*—Alvin H. Fritschler

[57] ABSTRACT

Dual turbine-booster compressor units are arranged for advantageous liquefaction operations using high pressure heat exchangers.

20 Claims, 1 Drawing Sheet

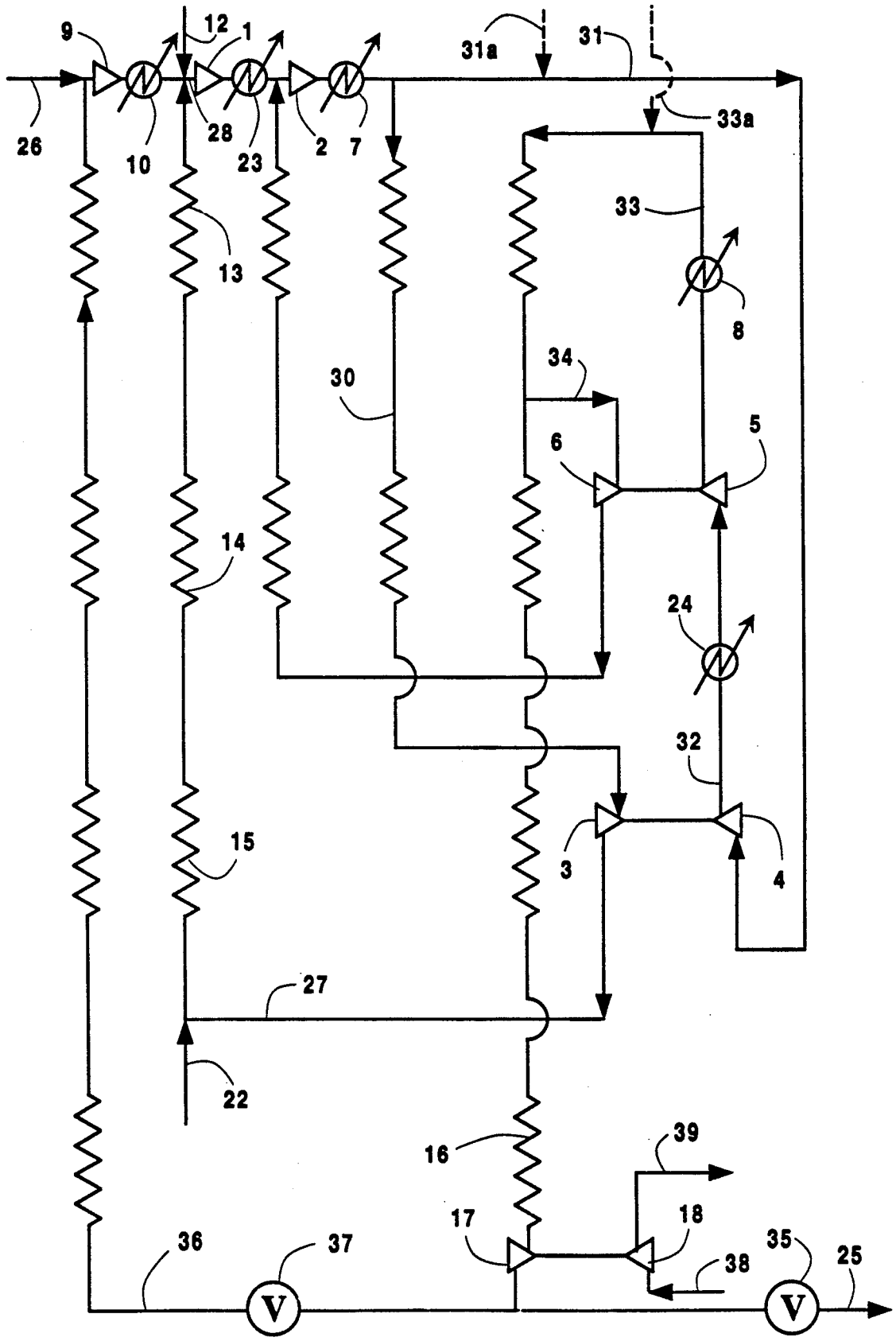
9
12
1
31a
31
26
10
28
23
2
7
33a
33
13
8
34
30
6
5
14
24
32
15
3
4
27
22
16
39
17
18
36
37
35
38
25
V
V

LIQUEFIER PROCESS

BACKGROUND OF THE INVENTION

1. Field of the Invention

The invention relates to high pressure liquefier operations. More particularly, it relates to improved energy efficiency in such operations.

2. Description of the Prior Art

Many processes, both once-through and recycle types, have been used to liquefy air separation products, namely nitrogen, oxygen and argon. Around the middle of this century, processes were employed in which feed air to an air separation plant was compressed to as high as 3,000 psig in piston type, positive displacement reciprocating compressors. The high pressure air was dried and cooled in shell and tube, or spiral-wound, heat exchangers and expanded through reciprocating, positive displacement, work extraction expanders to produce the refrigeration necessary for producing air separation liquids. Such high pressure operation offered significant liquefaction cycle thermodynamic efficiency advantages. However, the heat exchange equipment employed was bulky and expensive, and the reciprocating machinery was complex and costly, both from an investment and maintenance viewpoint.

In the late fifties, viable low pressure, multi-stage centrifugal compressors, radial-inflow turboexpanders and compact, cost-effective brazed aluminum heat exchangers became commercially available. Low pressure recycle nitrogen processes were employed to utilize this new equipment for the production of refrigeration to liquefy air separation products. The low aerodynamic efficiency of said machinery and the thermodynamic disadvantage of low pressure operation resulted in liquefaction systems whose energy efficiency was, at times, lower than that of the high pressure systems they replaced. However, investment and maintenance requirements were lower. By the early eighties, steady advances in working pressure and maximum size availability of brazed aluminum heat exchangers, improvements in aerodynamic efficiency of centrifugal compressors, and the commercial availability of multi-stage, centrifugal, high pressure, nitrogen recycle compressors with matching cryogenic turboexpander/booster assemblies were utilized in both recycle and single pass liquefaction cycles with maximum pressures as high as 770 psig. Energy efficiency was significantly better for these newer designs than for the earlier, low pressure turbomachinery-based systems. At the present time, most air separation liquids are manufactured by liquefiers of such improved design.

Typical configurations of the present type of nitrogen liquefier is illustrated in the Hanson et al patent, U.S. Pat. No. 4,778,497. As shown therein, first feed nitrogen is supplied to the suction of a three or four stage recycle compressor from the discharge of the feed compressor supplied with low pressure nitrogen from an air separation plant. Additional feed is often supplied as warmed vapor from the high pressure column in the air plant. The nitrogen recycle compressor pumps this feed and the returning recycle nitrogen stream from the liquefier cold box from a pressure of typically about 80–90 psia to about 450–500 psia. The total recycle compressor discharge stream is further compressed to about 700 psia by warm and cold turbine boosters arranged in parallel as shown in the Hanson et al patent. For this liquefaction cycle arrangement, parallel rather than series arrangement of the boosters results in the most advantageous dimensionless aerodynamic performance parameters for the booster compression stages. The high pressure stream exiting the boosters is successively cooled in the cold box brazed aluminum heat exchangers and divided between the warm turbine, cold turbine and the product stream. The exhaust from both turbines is warmed in the heat exchange system and returned to the suction of the recycle compressor.

In 1985, large brazed aluminum heat exchangers with working pressure capability of 1,400 psig became available. For a number of reasons, the nitrogen liquefaction process described above is not able to benefit from the thermodynamic advantages of operating at this higher pressure level. With both turbines operating at a pressure ratio of about 8, e.g. 700 psia to 88 psia, the sum of the temperature drop across the two machines equals the total temperature range from ambient to saturated vapor temperature at the cold turbine exhaust. Increasing the inlet pressures of the turbines without increasing their outlet pressure would increase the temperature drop across the machines beyond that which can be efficiently used by the process. Thus, temperature mixing losses and/or two phase exhaust from the cold turbine would develop. Also, the pressure ratio across a single stage radial inflow turboexpander cannot be increased much beyond 8 because of aerodynamic design constraints. These problems could be avoided by increasing both the inlet and outlet pressures of the turbines proportionately to maintain the pressure ratio across them fixed at about 8. At a 1,400 psia turbine inlet pressure, exhaust pressure of the turbines and inlet pressure to the recycle compressor would be about 175 psia. The cold turbine exhaust temperature could not be lower than the saturation temperature of 107° K. at 175 psia which, in turn, would result in excessively high temperature and enthalpy of the supercritical product stream entering the flash separator, exported to the air plant, or passing to the subcooler for subsequent delivery to storage. The overall efficiency of the system is hurt by this reduction in the proportion of total liquefaction refrigeration that is provided by direct heat exchange contact with the turbine exhaust streams. In addition, increasing the exhaust pressure of the cold turbine and suction pressure of the recycle compressor above the operating pressure of the high pressure column in the air separation plant prevents direct transfer of either cold or warmed vapor from this column to the suction circuit of the liquefier. While various means for avoiding this problem can be attempted, they all add appreciable cost and complexity to the plant. As a result, therefore, the liquefaction processes operating at peak cycle pressures of 700–800 psia and currently used widely to liquefy nitrogen and air are not well suited for operating at higher peak cycle pressures.

The Dobracki patent, U.S. Pat. No. 4,894,076, discloses a turbomachinery-based, recycle nitrogen liquefaction process designed to take advantage of the commercially-available high working pressure brazed aluminum heat exchangers. As indicated in Table I, thereof, the patented process has a claimed energy efficiency advantage of about 5% compared to typical commercial liquefiers. The patented process uses three radial-inflow turboexpanders to span the temperature range from ambient to saturated vapor exhaust of the cold turbine. The warm turbine, taking aftercooled recycle compressor discharge gas at 489 psia as feed, discharges at recycle compressor suction pressure of 91 psia and 192° K. It provides all of the refrigeration required by the process down to the 200° K. temperature level. The remaining recycle compressor discharge gas is boosted from 490 psia to maximum cycle head pressure of 1,215 psia by two centrifugal compressor wheels absorbing power delivered by the three gas expanders. After cooling to 200° K. in the heat exchange system a portion of this stream is directed to the intermediate gas expander where it expands to 480 psia and 155° K. This machine provides process refrigeration between 200° K. and 155° K. The cold turboexpander is fed exhaust gas from the intermediate expander blended with a small trim stream of recycle compressor discharge gas which has been cooled in the heat exchange system to the same temperature. The cold expander exhausts at 94 psia at, or close to, saturated vapor. It provides refrigeration between 155° K. and 99° K. The turbine exhaust stream after being warmed in counter-current heat exchange with incoming feed stream returns to the recycle compressor suction. The liquid, or dense fluid expander, expands the cold, supercritical product nitrogen stream from 1,206 psia to 94 psia for further heat content reduction before export to the air separation plant as refrigeration supply for production of subcooled liquid products. While the patented process is disclosed as having an overall energy efficiency better than the prior art by about 5%, there nevertheless remain several deficiencies and disadvantages that are desired to be overcome to further advance the liquefier art.

The power requirement of the Dobracki patent process is 2.3% greater than that of the invention herein described and claimed. Two factors contributing to this circumstance are that its reported cycle pressure of about 1,200 psia is lower than the currently preferred 1,400 psia level of the subject invention, and, secondly, the power generated by the liquid turbine is not recovered to accomplish useful work. Furthermore, the cycle is more complicated because it uses three nitrogen gas turbines and one liquid turbine with incremental investment and maintenance costs being high because of the use of four machines as compared to the simpler scheme of the subject invention involving two gas turbines and one liquid turbine.

The cycle arrangement of the Dobracki patent will be seen to preclude achieving the thermodynamic advantage theoretically available from increasing process head pressure to 1,400 psia, the maximum working pressure capability of today's brazed aluminum heat exchangers, or desirably up to 2,500 psia.

It will thus be seen that it would be highly desirable in the art to have high pressure liquefier processes capable of advantageously employing heat exchangers with working pressure capability up to 1,400 psia. It should also be noted that, in many instances where the liquefier is integrated with an air separation plant, it would be advantageous to have the flexibility of lowering the cold turbine exhaust pressure and recycle compressor inlet pressure to permit exporting either or both warmed and cold nitrogen vapor from the air separation plant's high pressure column without compression, as feed to the liquefier. Modern air separation plants with structured packing-filled distillation columns are being designed with high pressure nitrogen column pressures as low as 68 psia. The process of the Dobracki patent does not have the flexibility of operating at a recycle compressor suction pressure this low. If it were attempted, either very large liquid content would develop in the cold turbine exhaust, or large temperature mixing losses would occur between the heat exchanger zones. This problem could be resolved by operating at a maximum cycle pressure of about 900 psia, but this would result in a significant reduction in cycle energy efficiency.

It is an object of the invention to address these various problems in the art so as to provide an improved high pressure liquefier process and system capable of utilizing high pressure heat exchangers and of achieving significant process energy savings over current practices in the art.

SUMMARY OF THE INVENTION

Dual turbine-booster compressor units are arranged specifically to provide advantageous machinery design parameters and effective cooling curve characteristics. High pressure heat exchangers with multiple passes are employed to accommodate the desired process arrangement. Final liquid product expansion can utilize a liquid turbine.

BRIEF DESCRIPTION OF THE DRAWING

The invention is hereinafter described with respect to the accompanying schematic drawing of a base case embodiment of the nitrogen liquefier process of the invention.

DETAILED DESCRIPTION OF THE INVENTION

The object of the invention is accomplished by an improved liquefier process and system that desirably employs two gas turbines and one liquid turbine such that investment and maintenance costs are minimized, the power requirements are reduced, and overall operating efficiency is achieved.

In the practice of an embodiment of the invention, warming cold turbine exhaust at, e.g., 72.5 psia joins feed compressor discharge and the medium pressure feed to provide suction to the first stage of the nitrogen recycle compressor. After two stages of compression, this stream is joined by warming warm turbine exhaust for the second two stages of recycle compression. A portion of the 577 psia recycle compressor discharge stream is extracted and cooled in the brazed aluminum heat exchanger for cold turbine feed. The remaining portion of the recycle compressor discharge stream is directed through the cold and warm turbine boosters in series from which it is delivered to the cold box at 1,400 psia. After cooling in the first zone of the brazed aluminum heat exchanger, a portion of this stream is extracted as warm turbine feed, with the remaining product fraction being cooled and condensed before entering the subcooler. The cold, high pressure, supercritical product stream that exits the subcooler is processed through the liquid turbine whose exhaust enthalpy is very near that of saturated liquid nitrogen at one atmosphere pressure. A portion of the liquid exhaust stream is throttled into the subcooler brazed aluminum heat exchanger as refrigerant, where it is boiled and superheated before being warmed in the heat exchange system and passed to the feed compressor suction. The remainder of the subcooled liquid turbine exhaust stream leaves the liquefier for storage or for refrigerant supply to an air separation plant. The feed compressor collects warmed flash gas from the subcooler and fresh, low pressure feed from the air separation plant for delivery to the suction of the recycle nitrogen compressor.

With reference to the drawing, saturated vapor nitrogen exhausting from the radial-inflow cold turboexpander 3 in line 27 at 81 psia may be joined by a small stream of cold, medium pressure nitrogen gas imported from the lower column of an air separation plant in line 22 before it is warmed successively in brazed aluminum heat exchanger zones 15, 14 and 13 to ambient temperature. The thus-warmed gas is joined, from line 26, by after cooled discharge nitrogen from feed compressor 9 and aftercooler 10, and by medium pressure nitrogen feed 12, which is imported from the high pressure, lower column of an air separation plant (not shown) as make-up after having been warmed to ambient temperature in that system's heat exchange system. The combined stream is passed in line 28 to the first zones of recycle nitrogen compression in recycle compressor 1. The compressor typically consists of two centrifugal stages of compression mounted on opposite ends of a geared pinion meshed with a motor driven bull gear. The compressed nitrogen is intercooled between the two stages of compression represented generally by recycle compressor 1, and is cooled thereafter in aftercooler 23 as it leaves the first compressor zone at 211 psia. Exhaust nitrogen in line 29 from the warm radial-inflow expander 6 at 217 psia and 158° K. is warmed successively in counter-current brazed aluminum heat exchanger zones 14 and 13 before joining the after cooled discharge nitrogen leaving aftercooler 23 upon exiting from the first zone of recycle nitrogen compression. The combined stream is delivered to the suction of the second zone of recycle nitrogen compression, i.e. recycle compressor 2. This compressor will likewise typically consist of two stages of centrifugal compression mounted on opposite ends of a geared pinion, which is driven by the same bull gear driving the first zone of recycle nitrogen compression. Intercooling is provided between the two compression stages, and discharge nitrogen passing at 577 psia in said line 28 from recycle compressor 2 is after cooled in aftercooler 7.

The recycle nitrogen stream leaving the two zones of nitrogen recycle compression is divided into two streams. The first stream passes in line 30 for cooling sequentially in counter-current brazed aluminum heat exchanger zones 13 and 14 before entering cold expander 3. After work-extraction expansion in expander 3, the exhausted stream is directed through line 27 as indicated above. The second stream of nitrogen leaving the two zones of nitrogen recycle compression is passed through line 31 to the inlet of cold turbine booster 4. The cold turbine/booster assembly consists of a bearing-supported spindle on one end of which is mounted a radial-inflow expansion zone 3 and on the other end a centrifugal compression stage 4. Power delivered to the spindle by work extraction from the expansion stream is absorbed by the compression stage (less minor bearing and windage losses). Cold booster 4 raises the pressure of the stream of nitrogen gas passing through it from 574 psia to 805 psia. The cold booster discharge stream is removed in line 32 and is after cooled in aftercooler 24 before further compression to 1,400 psia in warm turbine booster 5.

The high pressure, warm booster discharge stream from warm turbine booster 5 is passed in line 33 to aftercooler 8 before entering brazed aluminum heat exchanger zone 13 for countercurrent cooling to 262° K. before being divided into two streams. The first stream is delivered through line 34 to the inlet of warm turbine 6 for near-isentropic work extraction expansion. The exhaust stream from the turbine is directed through line 29 as indicated above. Power generated by warm turbine 6 expansion is delivered to the spindle driving warm booster 5.

The second portion of the high pressure nitrogen stream leaving the cold end of heat exchanger 13 in line 30 is cooled successively in counter-current brazed aluminum heat exchanger zones 14, 15 and 16 before entering liquid turbine 17 at 1390 psia and 79.6° K., i.e. a high pressure supercritical dense fluid. A near-isentropic, work-extraction expansion occurs in liquid turbine 17. Exhaust from this turbine is passed as product recovered in line 25, containing expansion valve 35, for passage to storage and/or refrigeration supply to the air separation plant. A small stream of said refrigerant liquid is directed through line 36 containing valve 37 for boiling and superheating in subcooler, brazed aluminum heat exchanger zone 16. The low pressure vapor formed in said subcooler zone 16 is warmed to ambient temperature successively in counter-current brazed aluminum heat exchanger zones 15, 14 and 13 before passing in said line 36 for joining with low pressure product nitrogen in line 26 from the air separation plant to provide the inlet stream to nitrogen feed compressor 9. This compressor is usually a three stage, centrifugal, intercooled, integral gear unit that delivers its output stream through said aftercooler 10 to the suction of recycle compressor 1.

The liquid turbine/booster unit consists of a doubled ended bearing-supported spindle on one end of which is mounted liquid turbine 17 and, at the other end, a small, centrifugal compressor stage 18 designed to operate in parallel with the first stage of recycle compressor 1. Gas from recycle compressor 1 is passed to compressor stage 18 in line 38, and compressed gas is removed therefrom through line 39. Recovery of the available expansion work in this manner improves the energy efficiency of the liquefier by about 0.5%.

Those skilled in the art will appreciate that various changes and modifications can be made in the details of the invention as therein described without departing from the scope of the invention as set forth in the appended claims. In one such modification, heat exchanger zone 16 and heat exchanger passages from zones 15, 14 and 13 warming low pressure, flash-off nitrogen from liquid turbine 17 are taken out of service or eliminated. After expansion in liquid turbine 17, the product stream, which is at a higher enthalpy than in the embodiment of the drawing, is returned to the top of the high pressure or lower column of the air separation plant. Subcooled liquid oxygen, nitrogen and argon streams are exported from the air plant in exchange for the refrigeration supplied to the air plant by the subject nitrogen liquefier. In this embodiment, it is usually appropriate to export a small stream of cold, medium pressure nitrogen gas from the air plant to liquefier line 22 to efficiently balance the temperature distribution in the air plant's warm end heat exchange system. This configuration is preferred when the size and design of the air separation plant to which the liquefier is linked is such that subcooling of product liquid nitrogen, by means of heat exchanger 16, is more efficiently accomplished in the air separation plant.

In another embodiment of the invention, liquid turbine 17 is removed from the design illustrated in the drawing. This results in an increase of 5.7% in the power requirement for producing a fixed quantity of one atmosphere pressure, saturated liquid nitrogen. However, the process will operate without additional modification by the replacement of said liquid turbine with a suitable valve. This feature is useful when it is desired to simplify the plant or to reduce capital expenditures, or for temporary liquefier operation following a liquid turbine failure.

In another embodiment of the invention, no subcooler and no liquid turbine are employed. Product nitrogen in line 25 is directed to the top of the air separation plant lower column, and subcooled air separation product liquids are exported to storage from the air plant in exchange for the refrigeration supplied to it by the nitrogen liquefier.

It will be appreciated that, for the process pressure levels employed in the embodiment of the drawing, inclusion of zone 13 heat exchanger improves process efficiency by eliminating temperature mixing losses that would otherwise occur between zones 14 and 15. Temperature mixing loss occurs because the exhaust temperature of warm turbine 6 is warmer than the required inlet temperature of cold turbine 3. However, by adjusting process pressures to increase the pressure ratios across both turbines, the temperature drop across each turbine increases until the inlet temperature to the warm turbine is ambient. At this point, heat exchanger zone 13 is no longer required. Temperature mixing losses develop at part load. A simpler brazed aluminum heat exchanger can be used in this case than in the FIG. 1 embodiment. This approach may also be attractive for situations in which lower than design suction pressure is desired on the recycle compressor.

In a stand-alone air liquefier system embodiment, dry, carbon dioxide-free air from the air plant air compressor and prepurifier is supplied in line 12 as feed to the suction of recycle compressor 1. A suitable valve is provided in this supply line to permit operation of the liquefier with a lower suction pressure than air plant supply pressure. This feature enhances part load efficiency of the liquefier. Liquid air produced by the liquefier flows in line 25 to the lower column of the air plant. The refrigeration it provides permits export of subcooled air separation liquids from the air plant to storage. To balance temperature distribution in the air plant primary heat exchangers properly, it will usually be appropriate to supply a small, low temperature stream of air from the cold end of the air plant primary heat exchanger as feed to the liquefier through line 22. This arrangement can be attractive when the total liquid product desired is less than about 30% of the air separation plant air feed, when most of the liquid requirement is liquid oxygen, and when maximum feasible argon production is not desired.

In a further embodiment, the air liquefier is integrated with the air plant primary heat exchanger. This arrangement consolidates the primary heat exchangers of the air plant and the liquefier. The entire charge of air plant, carbon dioxide-free air feed is provided at pressure to the suction of the recycle compressor from air plant prepurifier 12. Air feed to the lower column of the air plant is a combination of a portion of cold turbine exhaust 22 and liquefier liquid air product 25. This arrangement has the major disadvantage of requiring that the cold turbine exhaust pressure be equal to, or greater than, the lower volume pressure of the air plant, which adversely affects part load performance of the liquefier. This embodiment would be considered when significant turndown capability of the liquefier is not desired, in addition to the reasons referred to above with respect to the stand-alone air liquefier system.

Those skilled in the art will appreciate that various other changes and modifications can be made in the details of the invention as described herein without departing from the scope of the appended claims. For example, the concept of subcooler 16 elimination could be combined with the concept of heat exchanger zone 13 elimination and the concept of liquefying air. Likewise, the use of subcooler 16 could be incorporated into the air liquefier embodiment. Furthermore, the use or elimination of the liquid turbine can be incorporated into any of the designs.

An embodiment of the drawing design case has been computed, using established simulations, to determine the operating conditions that may be used in specific applications of the invention, with the results thereof being shown in the Table below. For the design case, a warm turbine inlet pressure of 1,390 psia was selected because 1,400 psig is currently the most advantageous commercially suitable working pressure for blazed aluminum heat exchangers. Process studies have shown that as head pressure is increased to this level, energy efficiency continues to increase. With suitable, economic, higher working pressure heat exchangers, this process can be applied at higher pressure levels. The warm turbine inlet pressure for the alone-indicated type of liquefier can range from about 800 to about 2,500 psia with possible pressure ratio ranges across the warm turbine, the cold turbine, and the feed compressor being typically in the range of 6–9, 6–9 and 4–8 respectively.

TABLE

| Recycle Liquefier Process | PSIA | TEMP. °K. |
|---|---|---|
| Recycle Compressor Inlet to Zone #1: | 70 | 300 |
| Recycle Compressor Inlet to Zone #2: | 210 | 300 |
| Warm Turbine inlet: | 1390 | 260 |
| Cold Turbine Inlet: | 570 | 170 |
| Warm Booster Inlet: | 800 | 300 |
| Cold Booster Inlet: | 570 | 300 |

The improved high pressure liquefier process of the invention utilizes dual turbine-booster compressor units in a very particular manner enabling effective cooling curve characteristics to be achieved with good machinery design parameters.

Those skilled in the art will appreciate that a variety of novel features and benefits pertain with respect to the practice of the invention. Thus, warm turbine feed plus liquefier product fraction are taken from the discharge of two turbine boosters operating in series. In addition, warm turbine outlet is at an ideal pressure level for return, after warming, to the suction of stage three of a four stage recycle nitrogen compressor. Furthermore, the isentropic head across the warm turbine is below the level at which high nozzle mach number causes design difficulties in radial inflow turbines, with turbine aero design being consistent with current practice.

The arrangement of the invention, wherein two turbine boosters are arranged in series in the flow scheme, with the cold booster preceding the warm booster, results in advantageous operation of said boosters. It should be understood, however, that, in the practice of the invention, this processing sequence can be reversed. The cold turbine feed is the brazed aluminum heat exchanger-cooled nitrogen recycle compressor discharge stream. The cold turbine inlet stream does not pass through the turbine boosters.

In the practice of the invention, warmed cold turbine exhaust is fed to stage one of the nitrogen recycle compressor. The pressure thereof is relatively low, which permits attainment of a low enthalpy of the super-critical product stream cooled in countercurrent heat exchange against it. Subcooler, refrigeration requirements are reduced by this feature.

The low cold turbine outlet pressure permits supply of either cold or warmed nitrogen vapor to the liquefier from an air separation unit's high pressure column. Cycle pressures can easily be adjusted, without cycle efficiency penalty, to bring the cold turbine outlet and the recycle compressor inlet pressure to a level permitting import of nitrogen vapor from a packed-distillation-column air separation unit.

While the invention has been described herein with particular reference to the recovery of a nitrogen liquid product stream, it should be understood that it is within the scope of the invention to practice embodiments thereof at appropriate conditions for air liquefaction and to produce other liquid products, such as oxygen, light hydrocarbons, e.g. methane, and the like.

The liquid turbine, if used in the process of the invention, can be located either upstream or downstream of the subcooler. If located upstream, it will likely be appropriate to phase separate its exhaust at cold turbine outlet pressure with the vapor fraction of this stream being returned to the cold turbine outlet line.

The liquefier of the invention can advantageously be turned down significantly from its full load production capacity. As the process uses relatively low nitrogen recycle compressor suction pressure, it is suitable for warm shelf gas supply from a low head pressure, packed distillation column air separation unit. Further reduction in recycle suction pressure is possible without compromising process efficiency. It should be noted that the makeup gas stream for the liquefier can be brought in at any temperature and pressure of the liquefier process at the appropriate location in the process arrangement, e.g. in line 31*a* or 33*a*.

The invention will thus be seen as providing an improved high pressure liquefier process. Because of the significant process energy savings obtainable in embodiments of the invention, the process of the invention provides a highly desirable advance over current practice in the art.

We claim:

1. An improved cyogenic liquefier process comprising:

(a) passing compressed nitrogen gas, upon cooling in brazed aluminum, multi-pass heat exchanger means to the inlet of a cold turbo-expander unit;

(b) recycling nitrogen gas exhausted from said cold turbo-expander unit through said heat exchanger means for the warming thereof to ambient temperature prior to passage to recycle compression means;

(c) compressing said recycled nitrogen gas in a two zone recycle compressor, a portion of the thus compressed nitrogen comprising said compressed nitrogen gas passed to the cold turbo-expander unit;

(d) passing the remaining portion of the thus compressed nitrogen to the booster compression unit of the cold turbo-expander;

(e) further compressing the nitrogen from the cold turbo-expander booster compressor unit, upon cooling, to an elevated pressure of from about 800 to about 2,500 psia in the booster compression unit of a warm turbo-expander unit;

(f) dividing said nitrogen stream, at elevated pressure, into two streams;

(g) passing one stream of nitrogen at elevated pressure to the inlet of said warm turbo-expander unit for expansion therein;

(h) warming the nitrogen exhausted from said warm turbo-expander unit in said heat exchanger means;

(i) recycling the thus-warmed nitrogen from said heat exchanger means to the second zone of said two zone recycle compressor for compression therein, together with the recycle nitrogen from said cold turbo-expander; and (j) cooling said second stream of nitrogen at elevated pressure in said heat exchanger means;

(k) withdrawing a nitrogen liquid stream from said heat exchanger means in a recovery line; and (l) controlling the flow of said nitrogen liquid stream in the product recovery line, whereby the use of dual turbine booster compressor units, together with said brazed aluminum heat exchangers capable of operating at elevated pressures, enable the desired liquid nitrogen to be produced at desirable energy efficiency levels.

2. The process of claim 1 in which said elevated pressure is on the order of about 1,400 psia.

3. The process of claim 1 and including passing said cooled second stream of nitrogen to a liquid turbine unit for expansion therein.

4. The process of claim 3 and including passing said cooled second stream of nitrogen to a subcooler portion of said heat exchanger means prior to passage to said liquid turbine unit.

5. The process of claim 4 and including dividing said nitrogen liquid stream, and passing a large portion thereof from the process as desired liquid nitrogen product, and passing a small portion thereof through said subcooler portion of the heat exchanger means to form low pressure nitrogen vapor, warming said nitrogen vapor in the remaining portions of said heat exchanger means, and passing said nitrogen vapor to feed compressor means.

6. The process of claim 3 and including driving compressor means by said liquid turbine unit and compressing a portion of the recycled nitrogen gas in said compressor means.

7. The process of claim 6 in which the portion of recycled nitrogen gas compressed in said compressor means is a portion of the recycled nitrogen gas being passed to the first zone of said two zone recycle compressor.

8. The process of claim 1 and including passing said cooled second stream of nitrogen to a subcooler portion of said heat exchanger means, and including dividing said nitrogen liquid stream and passing a large portion thereof from the process as desired liquid nitrogen product, and passing a small portion thereof through said subcooler portion of the heat exchanger means to form low pressure nitrogen vapor, warming said nitrogen vapor in the remaining portions of said heat exchanger means, and passing said nitrogen vapor to feed compressor means.

9. The process of claim 1 in which said compressed nitrogen gas comprises dry, carbon-dioxide free air from the prepurifier portion of an air separation plant.

10. The process of claim 1 and including compressing make-up, external source nitrogen in said two zone recycle compressor.

11. An improved gas liquefier process comprising:

(a) passing compressed liquefier gas, upon cooling in brazed aluminum, multi-pass heat exchanger means to the inlet of a cold turbo-expander unit;

(b) recycling liquefier gas exhausted from said cold turbo-expander unit through said heat exchanger means for the warming thereof to ambient temperature prior to passage to recycle compression means;

(c) compressing said recycled liquefier gas in a two zone recycle compressor means, a portion of the thus compressed liquefier gas comprising said compressed liquefier gas passed to the cold turbo-expander unit;

(d) passing the remaining portion of the thus compressed liquefier gas to the booster compression unit of the cold turbo-expander;

(e) further compressing the liquefier gas from the cold turbo-expander booster compressor unit, upon cooling, to an elevated pressure in the booster compression unit of a warm turbo-expander unit;

(f) dividing said liquefier gas stream, at elevated pressure, into two streams;

(g) passing one stream of liquefier gas at elevated pressure to the inlet of said warm turbo-expander unit for expansion therein;

(h) warming the liquefier gas exhausted from said warm turbo-expander unit in said heat exchanger means;

(i) recycling the thus-warmed liquefier gas from said heat exchanger means to the second zone of said two zone recycle compressor means for compression therein, together with the recycle liquefier gas from said cold turbo-expander; and (j) cooling said second stream of liquefier gas at elevated pressure in said heat exchanger means;

(k) withdrawing a product liquid stream from said heat exchanger means in a recovery line; and (l) controlling the flow of said product liquid stream in the product recovery line, whereby the use of dual turbine booster compressor units, together with said brazed aluminum heat exchangers capable of operating at elevated pressures, enable the desired product liquid to be produced at desirable energy efficiency levels.

12. The process of claim 11 and including passing said product liquid to a liquid turbine unit for expansion therein.

13. The process of claim 12 and including passing said product liquid to a subcooler portion of said heat exchanger means prior to passage to said liquid turbine unit.

14. The process of claim 12 and including driving said compressor means by said liquid turbine unit and compressing a portion of the recycled liquefier gas in said compressor means.

15. The process of claim 14 in which the portion of recycled liquefier gas compressed in said compressor means is a portion of the recycled liquifier gas being passed to the first zone of said two zone recycle compressor means.

16. The process of claim 11 and including passing said cooled liquefier gas to a subcooler portion of said heat exchanger means, and including dividing said liquefier product stream and passing a large portion thereof from the process as desired liquefier product, and passing a small portion thereof through said subcooler portion of the heat exchanger means to form low pressure liquefier vapor, warming said liquefier vapor in the remaining portions of said heat exchanger means, and passing said liquefier vapor to feed compressor means.

17. The process of claim 11 in which said liquefier gas comprises air.

18. The process of claim 11 in which said liquefier gas comprises oxygen.

19. The process of claim 11 in which said liquefier gas comprises methane.

20. The process of claim 11 and including compressing make-up, external source liquefier gas in said two zone recycle compressor means.

* * * * *